United States Patent [19]

Aoki et al.

[11] 4,014,140

[45] Mar. 29, 1977

[54] HIGH-PRECISION CHAMFERRING APPARATUS

[75] Inventors: Sueo Aoki; Nobumasa Amamoto, both of Fukuoka, Japan

[73] Assignee: Nippon Tungsten Co., Ltd., Fukuoka, Japan

[22] Filed: Feb. 17, 1976

[21] Appl. No.: 658,521

[30] Foreign Application Priority Data

Feb. 19, 1975 Japan ..... 50-19877

[52] U.S. Cl. ..... 51/109 R; 51/125.5; 51/128; 51/129; 51/131

[51] Int. Cl.[2] ..... B24B 7/00

[58] Field of Search ..... 51/109 R, 125.5, 128, 51/129, 131, 101 R

[56] References Cited

UNITED STATES PATENTS

| | | | |
|---|---|---|---|
| 2,419,739 | 4/1947 | Spina | 51/131 |
| 3,024,575 | 3/1962 | Dreiling | 51/101 R |
| 3,405,484 | 10/1968 | Koppenwallner | 51/101 R |
| 3,435,563 | 4/1969 | Reaser | 51/101 R |
| 3,525,182 | 8/1970 | Ritter et al. | 51/101 R |

*Primary Examiner*—James L. Jones, Jr.

[57] ABSTRACT

Apparatus and method for automatically chamferring edges and corners of rectangular articles. According to the invention, an article blank is subjected, under control of a guiding means, to a grinding wheel for grinding the edges of the blank. A turning means is provided to change the orientation of the blank as the grinding means grinds a corner of the blank, the turning means adapted to give a complete revolution to the blank for chamferring all its edges and corners. A discharge device discharges the finished blank out of the apparatus.

3 Claims, 17 Drawing Figures

Fig. 2
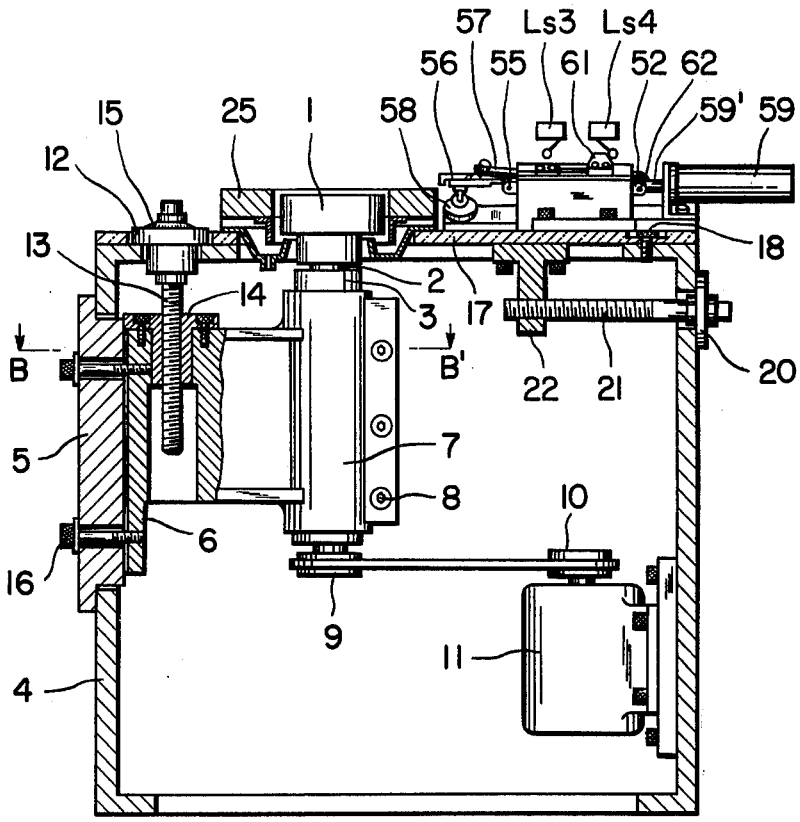
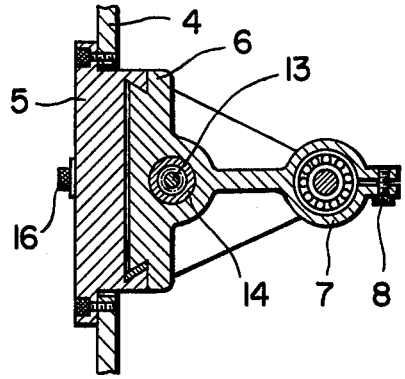
Fig. 3

28
19
95
27
4
89
18
95'
17
96
26
87
C
25
89'
88
D'
88'
86
83
32
92
91
90
93
85
82
113
17'
84
75
81
114
76
25'
80
77
98
34
79
7
97
2
33'
99
1
102
78
32'
36
110
111
68'
31'
3
100
101
112
74
73
72
71
68
64'
64
D
69
70
65
66
63
67
33
31
30
29
24
23

HIGH-PRECISION CHAMFERRING APPARATUS

BACKGROUND OF THE INVENTION

This invention relates to an apparatus for chamferring a rectangular article, especially machine tools such as the throw away tip with high accuracy.

Hithertofore, chamferring of a rectangular article such as the throw away tip was performed by a manual operation with low efficiency and insufficient accuracy. Also there has been available no chamferring apparatus for hard rectangular article such as throw away tip at its peripherical edges and corners with high accuracy in a continuous operation.

DESCRIPTION OF A PREFERRED EMBODIMENT

The invention will now been explained in detail referring to the attached drawings illustrating a preferred embodiment, wherein;

FIG. 2 is a partial section of FIG. 1;

FIG. 3 is a section of FIG. 2 along a line B — B';

Figure 1:
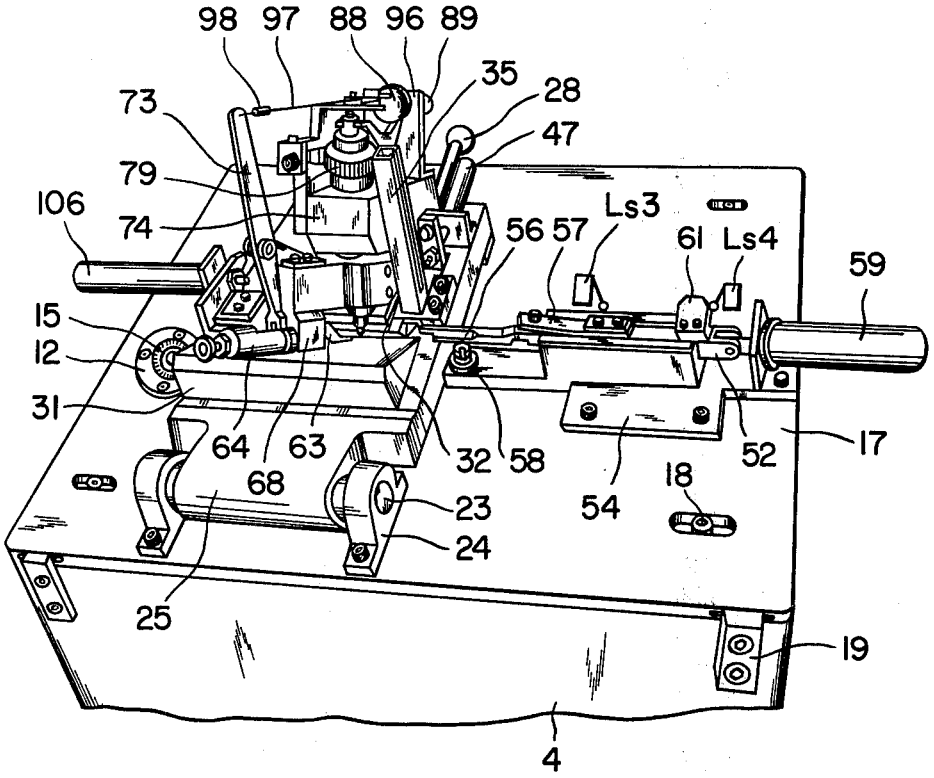
FIG. 1 is a perspective view of the apparatus.
Figure 11:
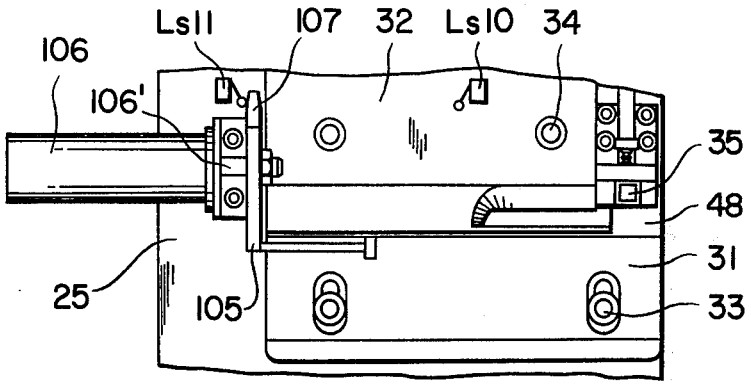
FIG. 11 is a top view of a discharge chute.

The apparatus of this invention comprises a magazine 35 containing a plurality of articles to be chamferred, e.g. tip blanks; feeder means including a lever 56 and a ram 59 for properly transferring the blanks to the chamferring position; guide means including guide member 31, 32, for moving the blank being maintained at a predetermined inclination to a horizontal plane for chamferring the blank of its peripheral edges and corners to a predetermined dimension, as shown in FIG. 1; extruding means including an L-pusher 38 and a ram 47 (FIG. 7) for supplying the blanks in the magazine to the guide means; turning means including a pusher 63, a hollow shaft 75, a rack 93 and a ram 95 (FIG. 4) for changing the orientation of a blank being biased to the guide means to successively chamfer the blank corners; a grinding wheel 1 (FIG. 2) for grinding the blank supported in the guide means; and discharge means including a discharge chute 48 (FIG. 7) and a ram 106 (FIG. 11).

The operational features of the apparatus are that the feeder means moves the blank while being biased at the predetermined inclination to a horizontal plane for the edge grinding, that the turning means changes the orientation of the blank while being ground of a corner, and that the above-mentioned operations are performed in a sequential manner.

The operation of the apparatus of this invention will be explained in details in the following description.

Disposition and Turning of Grinding Wheel

As shown in FIGS. 2 and 3, the chamferring apparatus of this invention comprises a grinding wheel covered of its upper surface with polishing powder such as diamond which is fixed on the upper end of a vertical shaft 2 supported by a bearing 3. The bearing 3 is maintained by a cylindrical clamp 7 integrally formed with a supporting arm 6 with bolts 8. The supporting arm 6 in an opening of a frame 4 is fixed to the fixed plate 5 with bolts 16.

To adjust the vertical position of the wheel 1 a shaft 13 is threaded into a center hole of a slide block 12 rotatably supported in the frame 4. A dial 15 is provided on the upper surface of the block 12. A cylindrical member 14 is fixed to the arm 6, which is provided with a threaded hole to receive the shaft 13.

It is possible to adjust the vertical position of the wheel 1 when the hole into which the bolt 16 of the fixed plate 5 is threaded is formed in a form of a vertical slot so that the rotation of the block 12 produces a vertical movement of the block 14. A pulley 9 is mounted on the lower end of the shaft 2, and a belt engages with the pulley 9 and another pulley 10 on an electric motor 11 fixed on the frame 4. To adjust the horizontal position of a bed 17 disposed on the frame 4, an adjustment shaft 21 is provided through a hole formed in the side of the frame 4. One end of the shaft 21 is supported in a rotatable block 20 having a knob, and the other end is threaded into a threaded hole of a T-shaped member 22. Since the head of the member 22 is secured to the bottom surface of the bed 17, the horizontal position of the bed may be adjusted by the rotation of the shaft 21. After the adjustment of the horizontal position, the bed 17 is fixed to the frame 4 with bolts 18.

Figure 4:
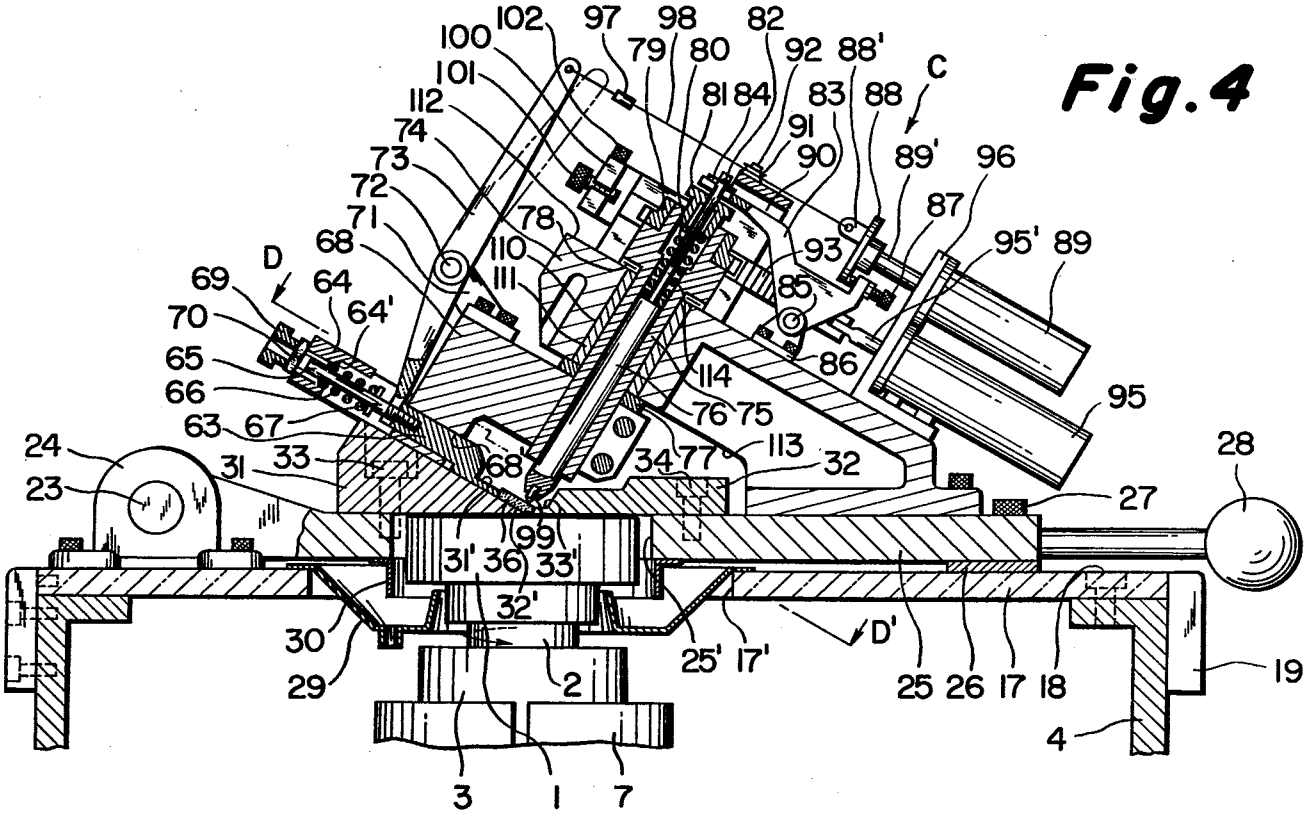
FIG. 4 is a side sectional view of the apparatus.

The arrangement of the wheel 1, bed 17 and the base 25 is shown in FIG. 4. The bed 17 and the base 25 thereon are provided with openings 17' and 25' respectively through which the wheel 1 is inserted, and a main guide 31 and a guide 32 are secured on the upper surface of the block 25 with bolts 33 and 34 in a spaced relation.

As mentioned below, these guides form a V-shaped groove, and to adjust the width of the groove the main guide 31 is provided with an elongated hole through which the bolt 33 may be inserted.

For the purpose of easy repair of the apparatus the base 25 is rotatably mounted on the bed 17. To this end, the base 25 is provided with a through hole at one end into which a shaft 23 is inserted, said shaft being supported by bearings 24 at opposite ends as shown in FIGS. 1 and 4.

A liner 26 is inserted between the bed 17 and the base 25 so that the upper surface of the base is disposed parallel to the grinding surface of the wheel 1. After adjustment of the horizontal position of the base with the liner, the base is fixed with the bolts 27, the adjusting operation being performed easily by using a handle 28 affixed to one end of the base. A lubricant pan 29 is provided in an opening 17' of the bed 17, and a splasher 30 is provided in an opening 25' of the base.

Loading of Blanks in Magazine

Figure 7:
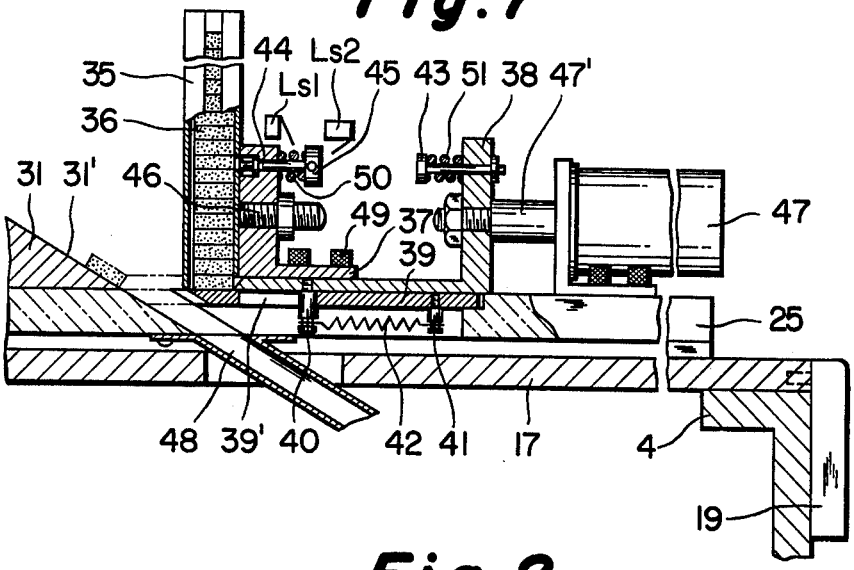
FIG. 7 is a section of a magazine unit.

As shown in FIGS. 1 and 7, a magazine 35 containing a plurality of rectangular articles 36, e.g. tip blanks to be ground and an L-stand 37 secured to the back of the magazine are fixed to the base with bolts 49. The magazine 35 is provided with front and rear openings at its lower end having a dimension to pass a single blank. To extrude the blanks successively from the magazine on the main guide, an L-pusher 38 is arranged between the stand 37 and the base 25 so that the pusher may slide on a guide plate 39. The cross section of the pusher arm conforms to that of the front and rear openings of the magazine 35. The vertical arm of the pusher is connected with a ram 47. An opening is formed in the base 25 in a position below the pusher 38 and its front wall is inclined coextensive with the inclined surface of the main guide 31, and its rear wall is vertical but enlarged to receive a guide plate 39. Said guide plate 39 is provided with an opening 39' through which a pin 40 is inserted, and the upper end of said pin is fixed to the horizontal arm of the pusher 38. The upper end of another pin 41 is fixed to the guide plate 39, and the lower ends of both pins 40 and 41 are protruding below the opening of the base and connected together by a coil spring 42.

Extrusion of Blanks

When the ram 47 is extended the guide plate 39 is advanced supporting a single blank extruded by the pusher 38. Said guide plate having its front end coextensive with the inclined front wall of the opening of the base 25 is advanced and when said front end engages with the inclined wall the forward motion of the guide plate is stopped. Thereafter the ram 47 is further extended, and since the opening 39' of the guide plate has an elongated configuration along the advance direction, after the stoppage of the guide plate the pusher arm slides between the guide plate and stand 37 to push out the blank on the forward end of the guide plate onto the inclined surface of the main guide.

To control the advance movement of the pusher 38, a stopper 46 is fixed to the stand 37 to engage with the ram rod 47' and stop the forward movement of the pusher 38. Detection means comprising pins 43, 44 and limit switches LS1, LS2 is provided to detect the existence of blanks in the magazine and completion of the extrusion of each blank. The pin 43 penetrates a hole formed in the upper part of the vertical wall of the pusher 38 and has a washer fixed thereto at its rear end to prevent the slipping out of the hole, and a coil spring 51 is disposed between the head of the pin and the pusher. In the same manner, a pin 44 is provided coaxially with pin 43, and a coil spring 50 weaker than the spring 51 is disposed between the head of the pin 44 and stand 37. On end of the pin 44 opposite to the head is of dimension to pass through a hole formed in the side wall of the magazine. When the pusher 38 is advanced by the extension of ram 47 and both heads of the pins 43 and 44 engage with each other, the weaker spring 50 is first compressed and the end of the pin 44 contacts with the side of a blank. If blanks less than a predetermined number exist in the magazine the pin 44 move further into the magazine and the head 45 will operate the switch LS1 detecting the unexistence of blanks in the magazine above a predetermined level. On the other hand, if blanks more than the predetermined number in the magazine, after the contact of the pin 44 with a blank the spring 51 is compressed, and when the lowermost blank is extruded on the main guide the head of the pin 43 contact with the switch LS2 detecting the completion of blank extrusion. Then, when the ram is retracted the pusher and guide plate return to the original position shown in FIG. 7, and the following blank rests automatically on the guide plate 39.

Advance of Lever 56

Figure 8:
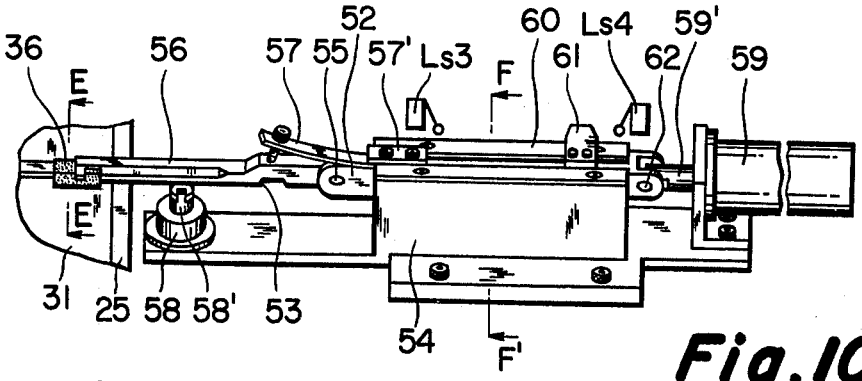
FIG. 8 is a perspective of a feeder unit.
Figure 10:
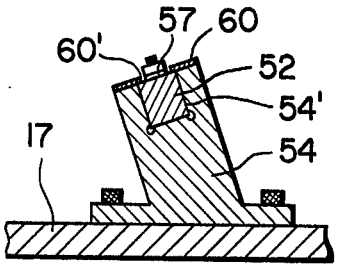
FIG. 10 is a section of FIG. 8 along a line F — F'.

Referring now to the feeder means, it comprises as shown in FIGS. 8 and 10 a ram 59, a ram rod 59' extending from said ram, a link 52 pivotally connecting said rod 59' and a lever 56.

Figure 9:
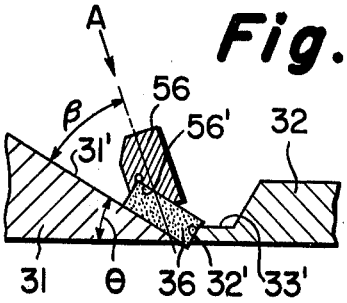
FIG. 9 is a section of FIG. 8 along a line E — E'.
Figure 12:
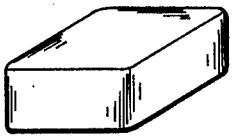
FIGS. 12 and 13 are respectively perspective view of a rectangular article before and after the chamferring operation.
Figure 13:
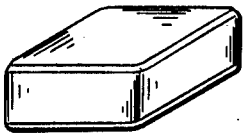
Figure 14:
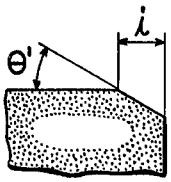
FIG. 14 shows an enlarged perspective of the chamferred portion.
Figure 15:
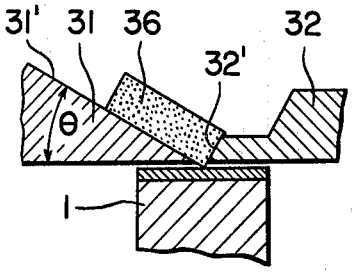
FIG. 15 shows the chamferring operation in section.

As shown in FIGS. 8 and 9, the lever 56 is provided with a rectangular notch V at its forward or left end and a recess 53 in its bottom surface. The link 52 pivotally connected with the lever 56 at pin 55 is slidably received in a groove 54' formed in the upper surface of an inclined support 54 secured to the bed 17. The inclination of the support 54 is determined by the chamferring angle as shown in FIGS. 12 and 13, 14 respectively indicating the umchamferred and chamferred blanks by use of the apparatus of this invention.

Specifically, in FIG. 9 showing the arrangement of the main guide 31, guide 32, the blank 36 and the lever 56 during the chamferring operation, the ramp or inclined surface 31' of the guide 31 to support the blank is angularly disposed at an angle $\theta$ with respect to the horizontal plane, and the edge surface 32' of the guide 32 disposed opposite to the main guide is inclined at an angle $(90° - \theta)$ with respect to the horizontal plane.

The spaced disposition of the main guide and the guide provides a narrow gap between the inclined surface 31' and the edge surface 32'. To bias the blank downward by the lever 56 so that the bottom surface of the blank contacts with the inclined surface 31' and one side thereof with the edge surface 32', it is necessary not only to assure the intimate contact of the blank with the V-notch 56' but also to apply a force to the lever 56 in the direction of A (FIG. 9) inclined at an angle $(\theta + \beta)$ with respect to the horizontal plane. Accordingly, the longitudinal center line of the groove 54' is disposed at an angle $90° - (\theta + \beta)$ with respect to a vertical plane.

To maintain the slidable engagement of the link 52 into the groove 54', a pair of holding plates 60 are fixed to the support 54 to cover a part of the surface of the link 52. An elongated gap 60' is formed between these plates 60, and a leaf spring 57 and its fixture 57' are disposed in the gap 60', one end of said spring being fixed to the link 52. As shown in FIG. 8, a stud is provided at the other end of the spring 57 so that the lower end of the stud is always biasing the lever 56 downward.

A dog 61 is provided on the rear or right end of the link 52 which extends above the gap 60' and senses the advance and retreat positions of the link 52 by the contact with limit switches LS3 and LS4 upon extension and retraction of the ram 59. The support has an extension on the front or left end which engages with a vertically extensible ram 58. A roller is provided at the upper end of the rod 58' of the ram 58 which engages with the bottom surface of the lever 56.

Biasing by Leaf Spring 57

As shown in FIG. 7, when a blank is extruded on the main guide 31, the limit switch LS2 senses the extrusion and causes extension of the ram 59. With this extension the lever 56 is advanced toward the extruded blank, and the V-notch 56' will receive the blank and be advanced together to a pusher shaft 76 (FIG. 4). A part of one edge of the blank is chamferred during this advance movement. In other words, when the recess 53 formed in the bottom surface of the lever 56 reaches the roller attached to the ram 58, the lever 56 is swung around the pin 55 by the downward force by the leaf spring 57. Thus the end of the lever 56 forces the blank in contact with the inclined surface 31' of the main guide 31 and the edge surface 32' of the guide 32 to extrude one edge of the blank through the gap between these guides below the bottom surface of the guides. As mentioned above, as a grinding wheel having a grinding surface thereon is rotatably disposed, the extruded edge of the blank may be chamferred, and the grinding operation is continued until the blank is moved to the extension of central axis of the pusher shaft 76.

Advance of Lever 56 (Grinding of the First Edge) and Stoppage Thereof

Figure 17:
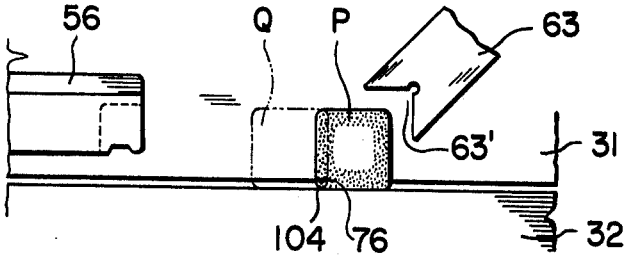
FIG. 17 is a partial rear view of the rotating position of the article.

Since the lever 56 is advanced by the ram 59 even after the recess 53 has engaged with the roller, the blank being chamferred is moved along the inclined surface 31' and edge surface 32', and when a corner 104 of the blank reaches an extension of the pusher shaft 76, i.e. a position P in FIG. 17, the dog 61 on the link 52 contact with the switch LS3 which causes the stoppage of extension of the ram 59.

Signals from the limit switch LS3 are used for stoppage of extension of the ram 59, initiation of extension of the ram 69 (FIG. 4) and retraction of the ram 47.

Extension of Ram 89

Referring to the turning means for chamferring the blank corner and turning it from the position P to a new position Q by an angle 90° as shown in FIG. 17, this means comprises as shown in FIG. 4 a fixed block 74 secured on the base 25 having the upper surface 112 and the bottom surface 113 both parallel to the inclined surface 31' of the main guide 31 secured to the base, further comprises a collar 77 engaging with the bottom surface 113, a rotatable block 68 disposed between the collar 77 and the main guide 31, a pusher 63 supported on the block 68, two rams 89 and 95 both secured on the upper surface of the block 74, a hollow shaft 75 inserted in the block 74 and a pusher shaft 76 disposed in said hollow shaft 75.

Figure 5:
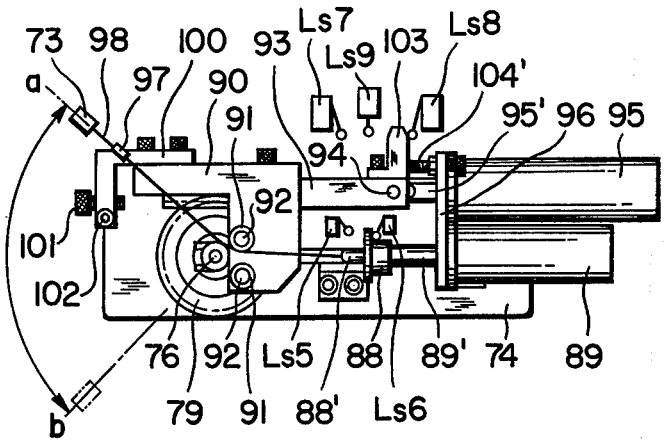
FIG. 5 is a top view from the direction of an arrow C in FIG. 4.

A stand 96 on which the rams 89 and 95 are mounted is secured on the upper surface 112 of the block 74. A collar ring 88 having a lug 88' is secured on one end of the ram rod 89'. Said lug 88' is connected with the upper end of a lever 73 with a wire 98, said lever being pivotally connected by a pin 72 with a bracket 71 secured on the upper surface of the rotatable block 68. As shown in FIGS. 4 and 5, said wire is provided with a tension adjusting ring 97 and is wound around a roller 91 rotatably supported around a pin 92 attached to a bracket 90 secured on the block 74.

The rotatable block 68 is provided with a through hole 68' in its lower portion through which a pusher 63 is inserted. A rectangular surface 63' is formed in the front end of the pusher for abutment with two adjacent sides of the blank, and the front end of the shaft 65 is threaded into the rear end of the pusher 63. The rear end of the shaft 65 is slidably inserted in the central hole 64' of a cylinder 64 fixed to the block 68. A coil spring 66 is disposed between an adjusting screw 69 threaded inside the hole in the cylinder 64 and a pin 67 attached in the central portion of the shaft 65. A lock nut 70 is used to set the adjusting screw 69 after the adjustment of the compression of the spring 66. Since the rear end of the shaft 65 is slidably inserted in the central hole 64' of the cylinder 64, the shaft 65 is biased by the elastic force in forward direction by the spring 66. Also the shaft 65 is caught in a forked end of the lever 73 between the pin 67 and the pusher 63. Accordingly, when the ram 89 is retracted the lever 73 is moved to a position in the phantom line in FIG. 4 causing the lower end of the lever 73 to compress the spring 66 and displace the shaft 65 away the blank. When the ram 89 is extended the wire 98 is loosened, and the lever 73 is rotated in the anticlockwise direction around the pin 72 by means of the spring 66, and simultaneously the shaft 65 moves toward the blank 36 and engages with the adjacent two sides of the blank and forces it toward the guide means.

For the corner chamferring operation, it is necessary to force the blank against the guide means. This may be performed by means of the aforesaid pusher 63 and the pusher shaft to be explained below.

The fixed block 74 is provided with a through hole 110 the central axis of which is perpendicular to the inclined surface 31' cf the main guide 31, i.e. inclined to the horizontal plane at an angle $\theta + 90°$, in which hole a bearing sleeve 111 is disposed. This sleeve supports the hollow shaft 75 which is housed in the through hole of the rotatable block 68 and has its lower end secured to said block. The hollow shaft 85 extends beyond the upper surface 112 of the block 74 and has an enlarged portion. A thrust bearing 78 is disposed between the enlarged portion and the upper surface 112 of the block 74. A pinion 79 is coaxially secured to the shaft 75 above its enlarged portion which engages with a rack 93. Said rack is slidably received in a groove formed in the bracket 90 and has its end pivotally connected to the ram 95. Thus the hollow shaft 75, the rotatable block 68 fixed thereto and the pusher 63 may be rotated between the positions of (a) and (b) shown in FIG. 6 with the extension and retraction of the ram 95.

Within the hollow shaft 75, there are disposed the pusher shaft 76 having an elastic body 99 at its lower end to engage with the blank 36, a shaft 114 coaxially attached to the upper end of said pusher shaft 76 and having a pin 82 and, an adjusting screw 81 threaded into the upper end of the shaft 75, and a coil spring 80 disposed around the shaft 114 between the lower end of the adjusting screw and the upper surface of the pusher shaft 76. A bracket 86 is secured on the upper surface 112 of the block 74 to support a shaft 85 which rotatably holds the lever 83. An adjustable pin or bolt 87 is threaded in the rear portion of the lever 83 which engages with the collar ring 88. A forked portion is formed in the front end of the lever 83 to stride over the shaft 114 protruding from the hollow shaft 75 between the washer 84 and the adjusting screw 81.

Since the ram 89 is normally retracted, the lever 83 is in a position slightly rotated in the clockwise direction by means of the contact between the collar ring 88 and the adjustable screw 87, and hence the forked end of the lever 83 maintains the shaft 114 and the pusher shaft 76 in an elevated position against the compression of the spring 80.

As mention as above, when the blank extruded from the magazine on the main guide is moved to the extension of the pusher shaft under chamferring the limit switch LS3 is operated, and the signal therefrom will cause the stoppage of the extension of the ram 59 and simultaneously cause the extension of the ram 89. The extension of the ram 89 will rotate the lever 93 by the spring 80 in the anti-clockwise direction lowering the pusher shaft 76, and the elastic body 99 affixed at the lower end of the pusher shaft forces the rear end 104 of the blank 36 against the inclined surface 31' of the main guide 31. The contact point of the body with the blank surface is adjacent to one corner of the blank as shown in FIG. 17. The extension of the ram 89 will loosen the wire 98, and the spring 66 will rotate the lever 73 in the anti-clockwise direction and at the same time force the rectangular or orthogonal plane 63' of the pusher 63 against the adjacent two sides of the blank thereby the blank is forced against the edge surface 32' of the guide 32 as shown in FIG. 9.

Release of Compression of Lever 56 and Retraction of Ram 58

When the ram 89 is extended the collar ring 88 will engage with the limit switch LS5 and the signal therefrom will cause the extension of the ram 58 releasing the compression of the lever 56 by the spring 57 and complete retraction of the ram 59 returning the lever 56 to the original retreat position.

Extension of Ram 98 (Turning of Blank)

Figure 16:
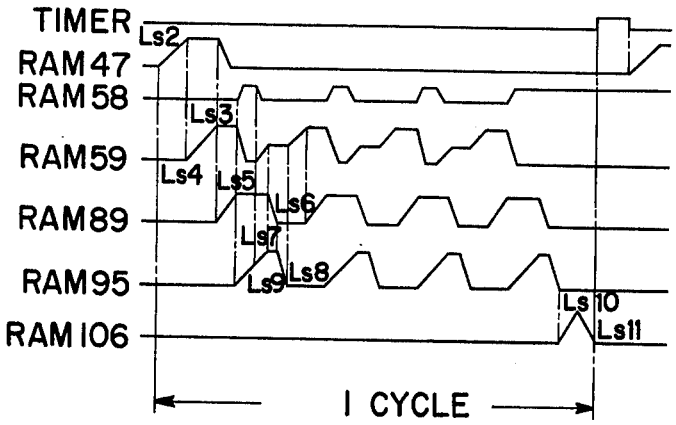
FIG. 16 is a diagram showing an operational sequence of ram units used in the apparatus of the invention.

As shown in FIG. 16 showing the timing diagrams of various rams, the ram 95 is extended by a signal somewhat retarded from the signal of the limit switch LS5. Since the rack 93 is pivotally connected with the front end of the ram 95 to engage with the pinion 79, the extension of the ram 95 will advance the rack along the groove formed in the bracket 90. Therefore the pinion 79 will rotate the hollow shaft 75, the rotatable block 68 attached to the shaft and the pusher 63 contained in the hole 68' of the block 68 together.

Figure 6:
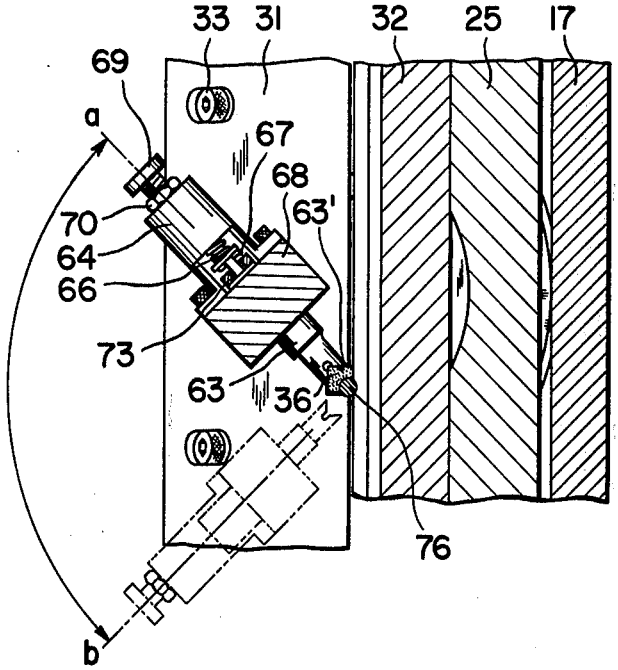
FIG. 6 is a section along a line D — D' in FIG. 4.

This rotation is continued from (a) position to (b) position of the pusher 63 as shown in FIG. 6, and during which the blank is chamferred at its corner under abutment with the main guide and the guide.

Retraction of Ram 89

When the pusher 63 reaches (b) position a new edge of the blank is exposed, and at the same time the rack 93 is advanced and the dog 103 attached to the rack engages with the limit switch LS7. The dog 103 may be stopped by an adjustable stopper 104'. A signal from the switch will stop the retraction of the ram 59 and initiate the retraction of the ram 89 thereby releasing the compression on the blank by the pusher shaft 76. An arm 100 is provided to control the advance position of the rack 93, said arm having a stopper bolt 101 and a lock nut 102 coaxial with the rack.

Extension and Stoppage of Ram 59

As mentioned above, the compression upon the blank is released when the rack 93 is in its advance position and the pusher 63 is in the (b) position, and then the blank is moved by the lever 56 under chamferring of its newly exposed edge and corner. To this end a dog 103 is provided on the rack 93 which engages with a limit switch LS9 upon the advance of the rack, and the signals from the switch cause the extension of the ram 59 and retraction of the ram 58. It should be noted at this point, however, the rams 89 and 95 return to their retracted positions before the lever 56 engages with the blank. The retraction of the ram 95 is performed by means of the limit switch LS6. Specifically, when the ram 89 returns to the retracted position, the collar ring 88 engages with the limit switch LS6 and the signal therefrom retract the ram 95 thereby returning the rotatable block 68 from (b) position to (a) position. It will be evident that at this stage the blank should be in a new position rotated by 90° from the original position defined by the lever 56. Therefore it would be necessary to advance the blank under chamferring to the position shown in FIG. 17 beforw turning of 90°.

Extension of Ram 59 (Grinding of Second Edge) and Its Retraction and Stoppage Though the ram 59 is extended upon the contact of the dog 103 with the limit switch LS9 as stated as above, said ram 59 is temperarily stopped by the limit switch LS7 when the lever 56 approaches the blank. Meanwhile, at this stage the ram 95 has already been returned to the retracted position, in which position the dog 103 engages with a limit switch LS8 which produces a signal indicating the completion of chamferring one set of edge and corner, said signal being delivered to a separately provided counter. The signal from the switch LS8 will extend the temporarily stopped ram 59 to the blank. In this stage the ram 58 is in the retracted position, but when the ram 59 is extended and the recess 53 contacts with the rollar on the upper end of the ram 58, the V-notch 56' compresses the blank downwardly by the elastic force of the spring 57. Upon further advance of the ram 59 the blank is chamferred of its new edge and advanced to the original position P, then the ram 89 is extended by the contact of the dog 61 with the limit switch LS3 continuing the following chamferring operation.

Repetitive Operations

The chamferring operation of a rectangular article such as the tip blank is performed by the continuous sequence of operations of the feeder and turning means in a repetition number (four times) set in the counter.

After the completion of all edges and corners on one side of the blank, a signal from the counter will extend the ram 106 (FIG. 11) in the discharge means to shift the blank by a discharge rod 105 secured to the ram along the V-notch formed by the main guide and the guide into a discharge shute 48 shown in FIG. 7. Upon extension of the ram 106, a dog 107 secured to the ram operates a limit switch LS10, a signal therefrom retract the ram 106, and when the dog 107 contact with a limit switch LS11, a signal therefrom stopps the ram 106.

After a predetermined period of time (e.g. three seconds) the above-mentioned chamferring operation may be repeated. A plurality of ram means used in the chamferring apparatus of this invention may be operated in the diagrams shown in FIG. 16 under an electrical control continuously and automatically.

Operation Sequence

Referring to the operation sequence of the apparatus of this invention, after loading a plurality of tip blanks into the magazine 35, the grinding wheel 1 is adjusted of its vertical position by the threaded shaft 13 depending on the desired chamferring depth. Turning the operation or start button to ON position, the wheel is rotated by an electric motor 11, and at the same time the ram 47 is extended, the blank is extruded on the main guide by the pusher 38, ram 59 is extended by the actuation of the limit switch LS2, and the lever 56 compresses the blank downwardly simultaneously advances it to the hollow shaft 75 under the chamferring operation. An actuation of the limit switch LS3 retracts the pusher 38, stops the movement of the lever 56 and extends the ram 89. As the ram 89 is extended the lever 83 is rotated in the anti-clockwise direction, thereby the pusher shaft 76 forces the blank against the edge surface 32' of the guide 32 and the inclined surface 31' of the main guide 31 through the elastic body disposed at the lower end of the pusher shaft 76. Upon the complete extension of the ram 89, the limit switch LS5 is actuated which extends the ram 58, releases the compression on the blank and retract the ram 59. The signal somewhat retarded from that of the limit switch LS5 extends the ram 95, and rotates the rotatable block 68 from (a) to (b) position through the rack 93 and the hollow shaft 75 thus turning the blank by 90° during which a corner is chamferred. Upon the extension of the ram 95, the limit switch LS9 is actuated by the dog 103, and upon completion of the extension the limit switch LS7 is actuated. The limit switch LS9 produces a signal to extend the ram 59 and advance the lever 56 simultaneously retract the ram 58, and the limit switch LS7 produces a signal to retract the ram 89.

Accordingly, the blank in the above-mentioned position turned by 90° is released from the compression of the pusher 63 and the pusher shaft 76, while as the limit switch LS6 is actuated by the completion of retraction of the ram 89 the ram 95 is retracted to return the rotatable block 68 from (b) to (a) position. The retraction of the ram 95 is completed by the signal from the limit switch LS8. The lever 56 advanced by the signal from the limit switch LS9 is temporarily stopped by the signal from the switch LS7, but when further advanced by the signal from the switch LS8, the lever compresses the turned blank. Thereafter the blank is advanced to the pusher shaft 76 under chamferring of the new edge, and the lever 56 is stopped by the signal from the switch LS3 to extend the ram 89. These operations of the feeder means and the turning means are repeated by the predetermined times, and when the chamferring operation is finished on one side of the blank, the ram 106 is extended by the signal from the counter to push the blank out of the discharge shute 48.

It should be understood that the arrangement described above constitutes the preferred embodiment and that many adaptations and modifications may be made without departing from the spirit of the invention offering chamferring operation of tip blank with high precision automatically.

We claim:

1. An apparatus for chamferring edges and corners of a rectangular article such as a throw-away tip with high precision comprising:

grinding wheel means for chamferring a blank;
guide means adjacent to said grinding wheel means;
feeder means for transferring the blank along the guide means under chamferring of one edge of the blank;
turning means for changing the orientation of the blank under chamferring of one corner of the blank; and
discharge means for discharging the chamferred blank out of the apparatus.

2. An apparatus for automatically chamferring rectangular articles with high precision comprising;

a magazine to be loaded with a plurality of blanks to be chamferred;
grinding wheel means for chamferring the blank by an adjustable level;
guide means adjacent to said grinding wheel means;
feeder means for transferring the blank along the guide means under chamferring of one edge of the blank;
extruding means periodically extruding each blank from said magazine to siad guide means;
turning means for changing the orientation of the blank under chamferring of one corner of the blank;
discharge means for discharging the chamferred blank out of the apparatus; and
electrical elements and circuits means for operating various elements or members in the above means in a predetermined time of sequence.

3. An apparatus as defined in claim 2:

said extruding means comprising a ram, a lever connected with said ram and sensing unit for detecting the reduced amount of blanks less than a predetermined number;
said feeder means comprising a ram, a lever pivotally connected to said ram, and biasing means to urge said lever holding the blank against the guide means;
said guide means comprising main guide and guide member for supporting the blank in an inclined position to a horizontal plane; and
said turning means comprising two rams, a lever swingable by one of said rams, and pinion-rack means for periodically turning the orientation of the blank by 90°.

* * * * *